US005247913A

United States Patent [19]

Manolis

[11] Patent Number: 5,247,913

[45] Date of Patent: Sep. 28, 1993

[54] VARIABLE VALVE FOR INTERNAL COMBUSTION ENGINE

[76] Inventor: John Manolis, P.O. Box 380, New York, N.Y. 10028

[21] Appl. No.: 982,886

[22] Filed: Nov. 30, 1992

[51] Int. Cl.[5] ..... F01L 1/34; F02D 13/06

[52] U.S. Cl. ..... 123/90.16; 123/198 F

[58] Field of Search ..... 123/90.15, 90.16, 90.27, 123/90.32, 90.48, 198 F

[56] References Cited

U.S. PATENT DOCUMENTS

| | | | |
|---|---|---|---|
| 4,249,489 | 2/1981 | Bruder et al. | 123/198 F |
| 4,556,025 | 12/1985 | Morita | 123/90.16 |
| 4,612,884 | 9/1986 | Ajiki et al. | 123/90.16 |
| 4,765,288 | 8/1988 | Linder et al. | 123/90.16 |
| 4,917,056 | 4/1990 | Yagi et al. | 123/90.16 |
| 5,163,389 | 11/1992 | Fujikawa et al. | 123/90.16 |

*Primary Examiner*—E. Rollins Cross
*Assistant Examiner*—Weilun Lo

[57] ABSTRACT

A variable intake valve for internal combustion engine comprising: A cam shaft, a valve with a valve head, a valve spring and a valve stem. A valve tappet is slidably extended into a sleeve guide between the cam shaft and the top of the upper end of the valve stem. The upper end of the valve stem is slidably extended into the valve tappet and a valve tappet spring is mounted on the top of the upper end of the valve stem. Also the upper end of the valve stem has a socket suitable to receive a locking pin. A locking mechanism mounted on the valve tappet comprises a locking pin controlled by a spring. The locking pin is slidably extended into the socket of the upper end of the valve stem when the locking mechanism is activated.

1 Claim, 1 Drawing Sheet

FIG. 1
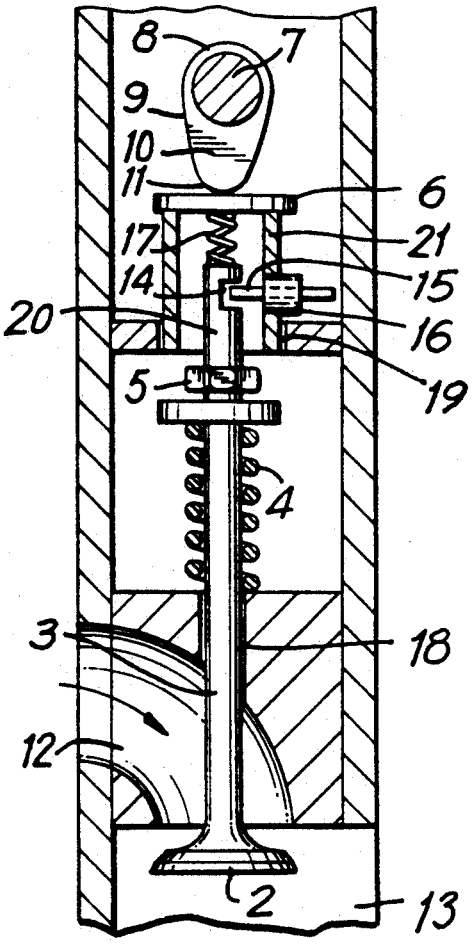
FIG. 2
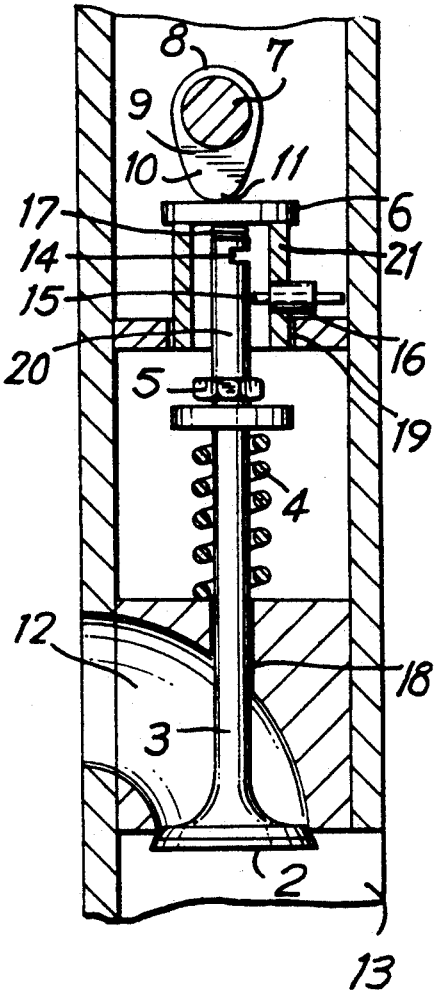
FIG. 3
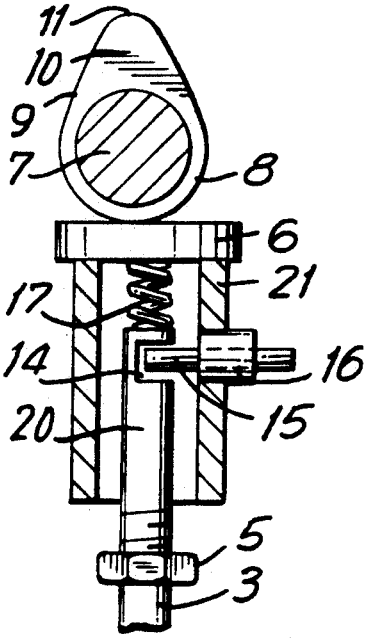
FIG. 5
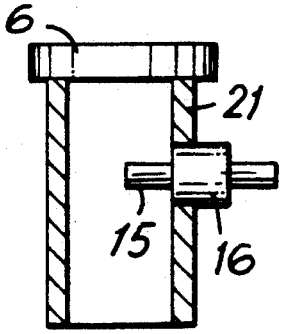
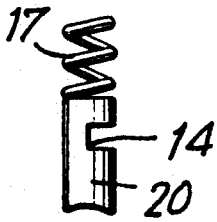
FIG. 6
FIG. 4
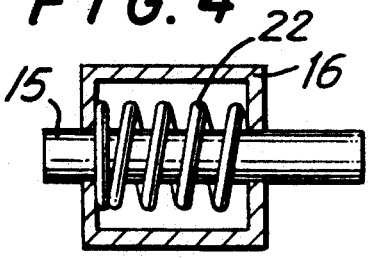

VARIABLE VALVE FOR INTERNAL COMBUSTION ENGINE

BACKGROUND OF THE PRESENT INVENTION

The present invention relates to a variable valve for internal combustion engine, and more particularly to a mechanical mechanism which will hold the valve in close position without changing the timing or the rotation of the cam shaft. The variable valve is controled both, manually, or by an on-board computer. With this type of control, a much higher ratio of air to fuel could be used to achieve higher fuel efficiency and low air pollution.

Many systems have been proposed to control and hold a valve of an internal combustion engine in close or open position during the engine's operation.

All these systems, however, possess many drawbacks and disadvantages, such as, they are expensive to manufacture and to maintain, and more important they are less efficient and less reliable as the temperature increases during the engine's operation. Therefor, there is a need to provide a variable valve for an internal combustion engine.

The variable valve comprises a cylindrical hollow valve tappet, a valve stem and a mechanical locking mechanism. The upper end of the valve stem is slidably extended into the cylindrical valve tappet in a vertical direction and it has a socket near the upper end of the valve stem. A valve tappet spring mounted on the top of the upper end of the valve stem. A mechanical locking mechanism is mounted on the wall of the valve tappet The locking mechanism has a locking pin which is extended into the socket of the valve stem, when the locking mechanism is activated.

SUMMARY OF THE INVENTION

It is an object of the present invention to provide a variable valve for an internal combustion engine.

It is another object of the present invention to provide a variable valve which has a cylindrical hollow valve tappet slidably extended into a sleeve guide between the cam shaft and the upper end of the valve stem.

It is still another object of the present invention to provide a variable valve, which has a socket near the upper end of the valve stem.

It is a further object of the present invention to provide a variable valve, which has a valve- tappet spring mounted on the top of the upper end of the valve stem.

It is still a further object of the present invention to provide a variable valve, which has a mechanical locking mechanism mounted on the cylindrical wall of the valve tappet.

It is yet another object of the present invention to provide a variable valve with a locking mechanism, which has a locking pin slidably extended into the socket of the valve stem.

DESCRIPTION OF THE DRAWINGS

FIG. 1 is a schematical longitudinal sectional view of a variable valve when it is in opening position FIG. 2 is the same as in FIG. 1 when the valve is in closing position.

FIG. 3 is a schematical longitudinal sectional view of a variable valve showing the locking pin of the locking mechanism slidably actuated into the socket of the upper end of the valve stem.

FIG. 4 is a schematical longitudinal sectional view of a locking mechanism.

FIG. 5 is a schematical longitudinal sectional view a valve tappet.

FIG. 6 is a vertical diagram of a socket at the upper end of the valve stem.

DESCRIPTION OF THE PREFERRED EMBODIMENTS

The present invention will be described in detail with reference to the preferred embodiments in conjuction with the accompanying drawings.

Referring now in more detail to the Drawing FIG. 1 a mechanical operated variable valve 2 which enables typical working locking and unlocking mechanism 16 to be provided for an intake valve in an internal combustion engine. The variable valve 2 is also suitable for use as an exhaust variable valve but this fuction is not further detailed since the intake valve duty is more onerous than that of the exhaust valve.

The combustion chamber 13 is isolated from an intake duct 12 by an intake valve 2. Valve 2 is formed integrally with a stem 3 which slidably is located in a sleeve guide 18. The upper end of stem 3 incorporates a socket or groove 14, also the upper end 20 of valve stem 3 is extended into a cylindrical valve tappet 6. A valve spring 4 is forcing valve 2 to stay in closing position, an adjusting screw 5 is provided to adjust the valve stem 3. A cylindrical hollow valve tappet 6 is slidably extended into a sleeve guide 19. The upper end 20 of the valve stem 3 is extended into the cylindrical valve tappet 6. A spring 17 is mounted on the top of the upper end 20 of the valve stem 3 and it is extended into the valve tappet 6.

A locking mechanism 16 is mounted on the cylindrical wall 21 of the valve tappet 6 and it has a locking pin 15, when the mechanism 16 is activated the locking pin is actuated and slidably extended into a socket 14 of the upper end 20 of the valve stem 3.

A cam shaft 7 comprises a cam base 8, a cam flank 9, a cam lobe 10 and a cam nose 11.

The valve spring 4 has greater force than the spring 17 which is located in the cylindrical valve tappet 6. The valve spring 4 is holding the valve 2 in closing position, the valve tappet spring 17 forcing the valve tappet 6 against the cam shaft 7.

Turning now to FIG. 2, the cam shaft 7 is rotating, the cam nose 11 of the cam lobe 10 is forcing the valve tappet 6 to move downward compressing the spring 17, as the valve spring 4 has greater force than spring 17 it is not compressed and it is forcing valve 2 to stay in closing position.

FIG. 3 the cam shaft 7 rotates and the cam lobe 10 releases the valve tappet 6 the valve tappet spring 17 is decompressed and it is forcing the valve tappet 6 to move upward. The locking mechanism 16 is horizontally leveled with socket 14 of the upper end 20 of the valve stem 3. The locking mechanism 16 is activated as a result the lockin pin 15 is actuated and extended into the socket 14. Thus the the valve stem 3 is engaged on the valve tappet 6 as shown in FIG. 1 and FIG. 3.

FIG.4, the locking mechanism 16 comprises a locking pin 15 and spring 22. The spring 22 is holding the locking pin 15 in unlocking position. When the locking mechanism 16 is activated, the spring 22 is compressed and the locking pin 15 is actuated and extended into socket 14 of the upper end 20 of the valve stem 3.

FIG. 5, the variable valve tappet 6 comprises a wall 21, the locking mechanism 16 is mounted on the wall 21 of the valve tappet 6, the locking pin 15 is mounted inside of the locking mechanism 16 and it is supported by spring 22, as it is shown in FIG. 4.

FIG. 6, the socket 14 on the upper end 20 of stem 3 is suitable to receive the locking pin 15 when the locking mechanism 16 is activated, so the valve tappet 6 is engaged on the valve stem 3, as it is shown in FIGS, 1 and 3.

Fuel efficiency: The present invention combines, for example, a six-cylinder combustion engine for power on the freeway with a two-cylinder engine for fuel efficiency in city driving. To accomplish this, the engine switches between three modes.

High-speed mode above 5,000 R.P.M. the locking mechanism 16 is activated and engaged on all six intake valves of the six-cylinder engine. The engine is fully operated with all six cylinders.

"Modulated displacement" mode between 3,400 and 5,000 R.P.M. the locking mechanism 16 is activated and engaged on four intake valves of only four cylinders of the six-cylinder engine. The engine is operated with only four cylinders leaving the other two cylinders inoperative.

"Modulated displacement" mode below 3,400 R.P.M. the locking mechanism 16 is engaged on two intake valves of only two cylinders of the six-cylinder engine. The engine is operated with only two cylinders leaving the other four cylinders inoperative.

Pollution control valve: The present invention provides a second variable intake valve for each cylinder of an internal combustion engine, which switches between two modes.

Low-speed mode, below 3,400 R.P.M the locking mechanism 16 is inactive and the second variable intake valve is forced to stay in closing position.

During high-speed mode, above 3,400 R.P.M., the locking mechanism 16 is activated and engaged on the second variable intake valve of each cylinder. The variable intake valve is synchronized to operate with the conventional intake valve of the same cylinder allowing additional air to flow therethrough into the combustion chamber to improve the combustion of the air-fuel mixture in the combustion chamber of the engine. This will increase fuel efficiency and reduce air pollution.

Moreover, the present invention can adopt modes of various modifications and deformations in addition to any suitable combinations of the aforementioned respective embodiments if it is within the scope of the claims.

What is claimed is:

1. An internal combustion engine including a variable valve system, the system comprising:

a cam on a camshaft;

a valve with a valve head and a valve stem;

a valve spring biasing the valve in a closing direction;

a valve tappet with a locking mechanism mounted on a cylindrical wall of the valve tappet, and a tappet spring mounted between the tappet and the valve stem for biasing the tappet into engagement with the cam, the valve spring having a greater force than the tappet spring;

a socket located at an upper end of the valve stem to engage and disengage a locking pin of the locking mechanism so as to connect and disconnect, respectively, the tappet to the valve thereby allowing actuation and non-actuation of the valve by the cam; and an actuation means selectively actuating the pin of the locking mechanism based on various engine conditions to control the operation of the valve.

* * * * *